US006058563A

United States Patent [19]

Bucknell

[11] Patent Number: 6,058,563

[45] Date of Patent: May 9, 2000

[54] DOOR SECURITY DEVICE

[76] Inventor: Martin John Bucknell, 39 Waveney, Grove Hill, Hemel Hempstead, Herts, United Kingdom

[21] Appl. No.: 09/199,133

[22] Filed: Nov. 24, 1998

[51] Int. Cl.[7] ..... E05F 5/02

[52] U.S. Cl. ..... 16/82; 292/297; 70/94

[58] Field of Search ..... 16/82; 292/338, 292/339, 297, 298; 70/94, 93, 416

[56] References Cited

U.S. PATENT DOCUMENTS

| | | | |
|---|---|---|---|
| 5,010,747 | 4/1991 | Norden, Jr. | 70/94 |
| 5,791,173 | 8/1998 | Montes | 70/94 |
| 5,799,521 | 9/1998 | Kennedy | 70/94 |
| 5,806,352 | 9/1998 | Axford | 70/416 |
| 5,899,509 | 5/1999 | Ferguson et al. | 70/93 |

*Primary Examiner*—James R. Brittain
*Assistant Examiner*—Mark Williams
*Attorney, Agent, or Firm*—Galgano & Burke

[57] ABSTRACT

A door security device, the device comprising in combination:

a bracket (3) defining a stop wall, the bracket (3) having a pivotal mount (18,20) to mount, in use, to an inner face of a door (10); and an elongate prop (1) having a first end (2) and a second end, (4) the first end (2) of the prop (1) having a pivotal mount (6, 8) to mount, in use, to a surface (13) such as a wall adjacent the door (10) and the second end (4) of the prop (1) being adapted to co-operatively engage with the stop wall (16,17) of the bracket (3) to brace the door (10) against the adjacent surface (13) when the bracket (3) is in a first radial orientation but to disengage the stop wall of the bracket (3) when the bracket (3) is turned about the bracket's pivotal mount (18,20), the bracket (3) being turnable about the mount (18, 20) by use of a key means (21) which is co-operatively engageable with the pivotal mount (18,20) of the bracket (3) from the outer face of the door (10).

10 Claims, 2 Drawing Sheets

DOOR SECURITY DEVICE

FIELD OF THE INVENTION

The present invention relates to an improved door security device of the type which comprises a prop or brace to prevent unauthorised opening of a door.

BACKGROUND OF THE INVENTION

Security devices for allowing restricted partial opening of a door but preventing full access through the door are used widely to enable the elderly, infirm or otherwise physically vulnerable to speak to visitors or receive deliveries at their doorstep without having to admit the visitor into their home.

The most common form of such security devices comprises a chain permanently attached to the jamb of a doorway, the free end of which may be selectively engaged with a socket fixed to the inside of the door so that the door may be restrained from opening beyond the limited distance allowed by the chain. Such devices are, however, far from ideal since they are susceptible to breakage by the determined intruder and can even be disengaged from the socket on the inside of the door in cases where the intruder is able to reach around the door opening.

More robust and substantial door guards have been developed comprising props or braces to brace the door against inward opening. These are not only far less susceptible to breakage by enforced entry, but are also far less accessible to tampering with from outside the door.

Examples of prior door braces or props are disclosed in U.S. Pat. No. 4,079,972; U.S. Pat. No. 4,070,049; PCT WO 89/03469; GB 2 186 909 A; GB 2 173 543 A; and GB 2 094 882 A.

In all of these security devices the brace or prop is a tube or bar, generally of metal and hollow, that extends from an anchorage on a wall or other fixed surface behind the door to a mounting attachment on the rear, i.e. inner, face of the door. In many of these cases the prop or brace is designed to be permanently or semipermanently attached to the rear face of the door and to selectively flex or telescope to disable the bracing action when it is not required.

These existing designs of prop-type door security devices increasingly have too many moving parts and fail to optimise performance characteristics with cost and ease of assembly. Furthermore, little consideration has been given in the prior art designs to the need for external disablement of the prop in case of emergency or by trusted visitors when the home occupant is unable to come to the door. Elderly home owners, for example, may have great difficulty in answering the door to visitors and yet may receive frequent visits by trusted individuals such as friends, relatives or care workers. It is important, therefore, that the home owner can give the trusted visitors means of externally disabling the door security device.

SUMMARY OF THE INVENTION

According to a first aspect of the present invention there is provided a door security device, the device comprising in combination:

a bracket defining a stop wall, the bracket having a pivotal mount to mount, in use, to an inner face of a door with the pivotal mount extending through the thickness of the door; and an elongate prop having a first end and a second end, the first end of the prop having a pivotal mount to mount, in use, to a surface such as a wall adjacent a door and the second end of the prop serving to co-operatively engage with the stop wall of the bracket to brace the door against the adjacent surface when the bracket is in a first radial orientation but to disengage the stop wall of the bracket when the bracket is turned about the bracket's pivotal mount, the bracket being turnable about the mount by use of a key means which is co-operatively engageable with the pivotal mount of the bracket from the outer face of the door.

Preferably the prop has an angle-stop to prevent the prop from swinging forward too far toward a said door whereby the prop will brace against the door or the side of the bracket rather than the stop wall of the bracket.

Advantageously the prop is of a unitary construction, being formed of a single tube of metal.

The prop suitably has a cap of plastics material at its second end.

Preferably the the bracket has a door-mounting base portion and the stop wall of the bracket is formed by a "V"-shaped extension of the door-mounting base portion.

The stop wall of the bracket suitably has a length in use, that is at least 50% greater than the diameter, or thickness, of the second end of the prop to facilitate alignment for cooperative engagement of the second end of the prop with the stop wall of the bracket.

Preferably the bracket is coated with a low friction paint or other polymeric coating.

The bracket preferably has a box-section base portion that defines a void or recess therewithin into which the pivot pin of the pivotal mounting extends, and the void or recess serving to allow a fastening means to be mounted to the bolt within the void or recess to fasten the bracket to the pivot pin.

Preferably the key-operated pivotal mounting of the bracket to the door is, upon turning of the key within the pivotal mounting, adapted to first advance the bracket away from the door and then turn the bracket.

According to a second aspect of the present invention there is provided a door security device of the first aspect of the invention installed with the first end of the elongate prop pivotally mounted to a wall or other surface adjacent a door and the bracket pivotally mounted to the door to be able to co-operatively engage with the second end of the prop.

BRIEF DESCRIPTION OF THE DRAWINGS

A preferred embodiment of the present invention will now be more particularly described, by way of example, with reference to the accompanying drawings, wherein.

DESCRIPTION OF THE PREFERRED EMBODIMENT

Figure 1:
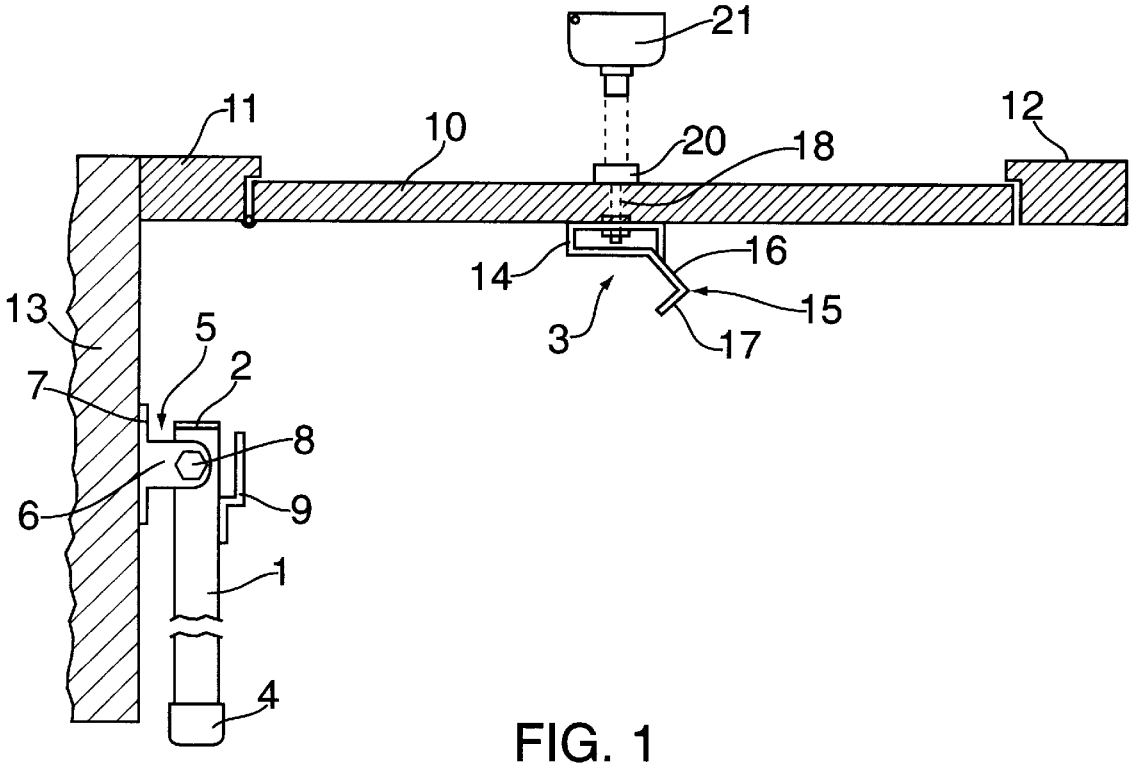
FIG. 1 is a plan view from above of the preferred embodiment of door security device installed to be able to brace between a door and an adjacent wall but with the prop stowed against the wall.

In the drawings, an inward-opening front door 10 is hung between door jambs 11, 12 and opens inwardly toward an adjacent wall 13.

The door security device of the present invention comprises two primary components—an elongate prop 1 anchored at a first end 2 to the adjacent wall 13; and a bracket 3 mounted to the inside of the door 10 and which cooperatively engages with the second end 4 of the prop 1 when the prop 1 is required to brace the door 10 part-open.

The prop 1 is suitably formed as a length of steel tubing which may be of factory predetermined length or cut to size to suit the circumstances of the place where it is to be installed. A length of 0.5 m, i.e. 200 inches, is not untypical. The steel tubing of the prop 1 is provided with an in-fill cap at its first end 2 and an over-mounting cap at its second end 4, each of nylon or other suitable low friction polymer. These caps help to reduce the risk of accidental chafing of paintwork or metalwork of the adjacent components or woodwork of the door and the cap at the second end 4 helps to facilitate dislodgement and disablement of the bracket by a key-operated mechanism to be described shortly.

The first end 2 of the prop 1 has a pivotal mounting 5 to the wall 13. This pivotal mounting 5 comprises a cradle 6 welded to a back plate 7 that is screwed to the wall 13 at a strategically selected position. The cradle 6 carries a pivot pin 8 which extends, in use, transversely through the first end 2 of the prop 1.

The depth of the cradle 6 and closeness of the pivot pin 8 to the first end 2 of the prop 1 is such as to allow the first end 2 of the prop 1 to pivot substantially freely about the axis of the pivot pin 8. This allows the prop 1 to be moved from a position lying adjacent the wall 13, as in FIG. 1, through an angle of greater than 90° to thereby be angled towards the door 10, as in FIG. 2.

The prop 1 is, however, restricted from moving beyond a predetermined forward directed angle—preferably 60° to 70° to the wall 13—by means of an angle stop flange 9 on the prop 1 near the first end 2 of the prop 1, which abuts the base of the cradle 6 or the base plate 7 when the prop 1 is at its extreme forward position. This angle stop flange 9 is important to prevent or minimise the risk of the prop 1 jamming against the door other than when properly co-operatively engaged with the door-mounted bracket 3 and it facilitates deflection of the prop 1 by the door 10 when the key-operated disablement mechanism is used, as described below.

Figure 2:
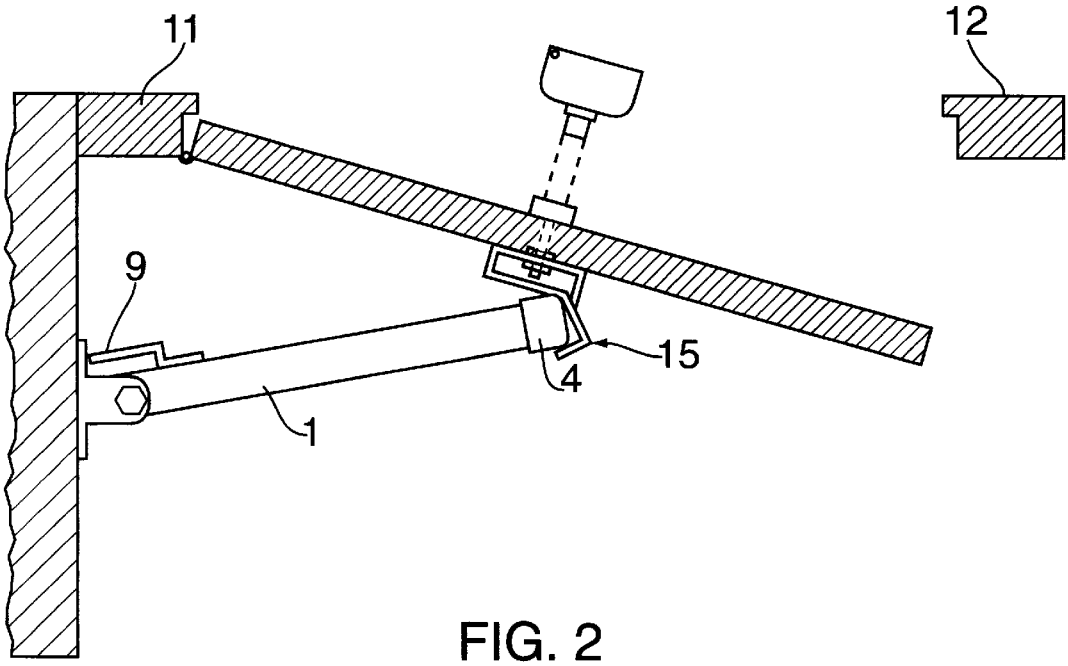
FIG. 2 is a view similar to that of FIG. 1 but with the prop in operative engagement with the stop wall of the door mounted bracket, bracing the door in a partially opened state.

The door-mounted bracket 3, as illustrated, has a base portion 14 of box section. A "V"-shaped extension 15 extends from one side of the base portion 14. The opposing faces 16, 17 of this "V"-shaped portion 15 together function as a stop wall or receiver for the second end 4 of the prop 1, and are suitably at least 50% longer than the diameter of the second end 4 of the prop 1 as illustrated in FIG. 2.

The base portion 14 of the bracket 3 is pivotally mounted to the door 10 by a bolt 18 that extends through the thickness of the door 10 and which is housed at least partially in a tubular sheath 20.

The box-section base portion 14 of the bracket 3 defines a void therewithin into which the bolt 18 extends and within which the bracket 3 is fastened to the bolt by a nut 22—a further nut 23 holds the bracket 3 to the bolt 18 so that the bracket 3 will turn with the bolt 18 when the bolt 18 is turned.

The sheath 20 is seated in the outer face of the door 10 but screwed in place on the inner face of the door and has an access opening for a key 21 whereby, when the key 21 is inserted into the access opening of the sheath 20 the bolt 18 may be turned within the sheath 20 and thereby also turn the bracket 3 about the pivotal axis of the bolt 18.

Figure 3:
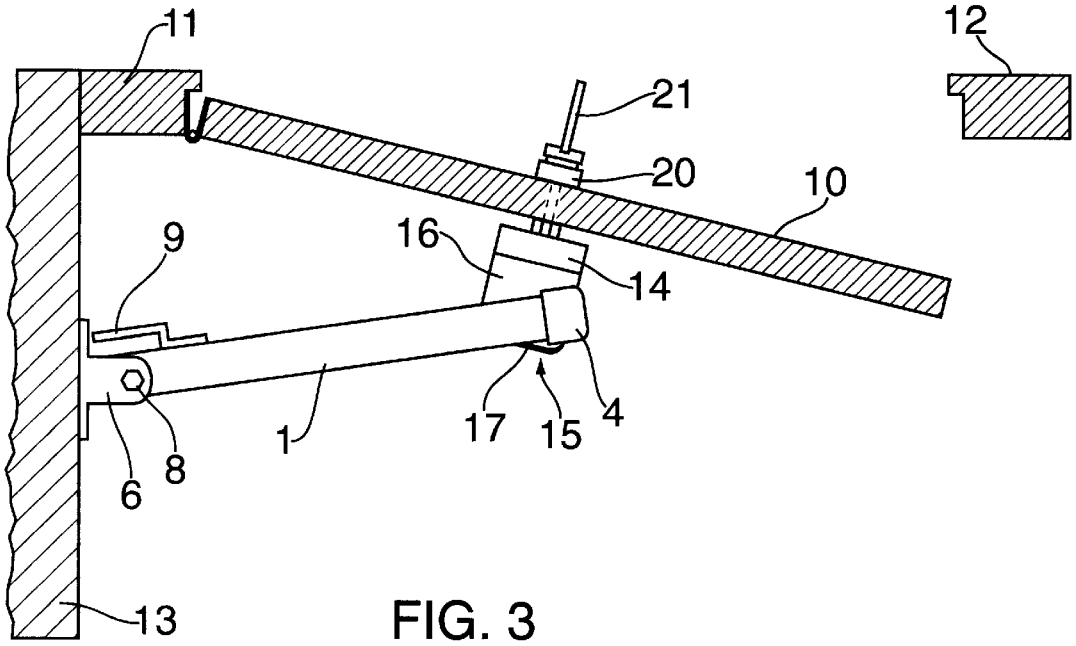
FIG. 3 is a view similar to that of FIG. 2 but with the stop wall of the bracket turned away from operative engagement with the prop by key-operated rotation of the bracket through 90°.
Figure 4:
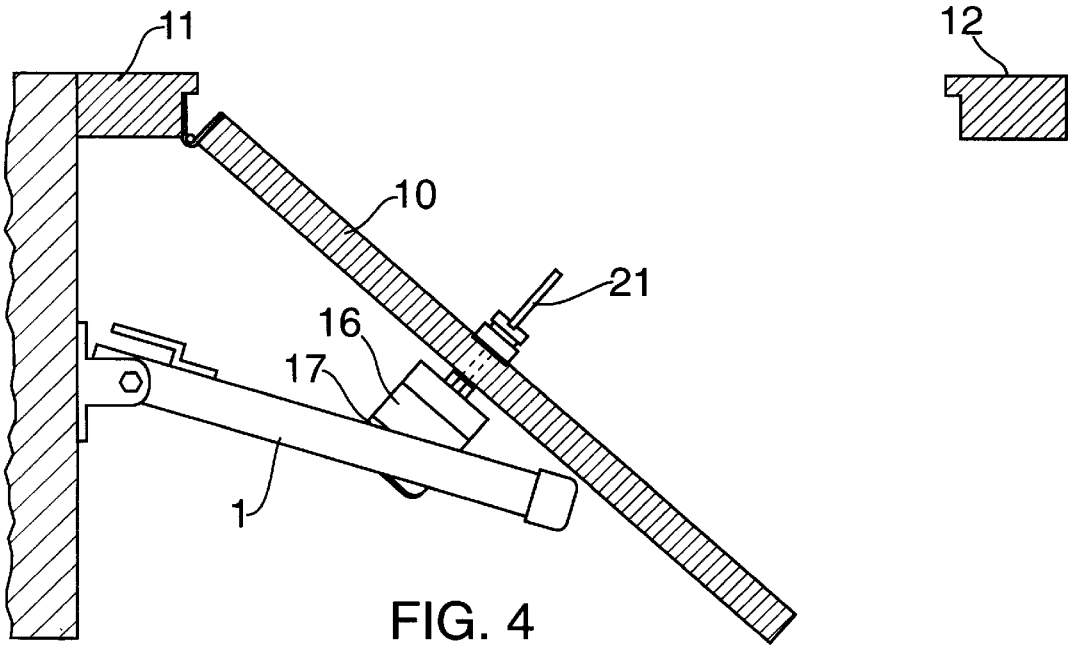
FIG. 4 is a view similar to that of FIG. 3 and showing the door in an advanced state of opening and the prop deflected away from bracing the door.

Referring to FIG. 3, this shows the key 21 inserted into the access opening of the sheath 20 and turned through an angle of 90°. The bracket 3 is correspondingly also moved through 90° such that the "V"-shaped extension 15 no longer serves as a stop wall and the prop 1 simply slides straight over it. The bracket's turning angle of 90° is optimal for dislodgement of the prop 1, but may be 75° or less.

The key-operated pivoting mechanism 18, 20 may conveniently be of a proprietary type such as the VISE ACTION™ latch mechanism manufactured under product code E3 35 15 by SOUTHCO Manufacturing Co Inc. Such a mechansim has the further benefit that the turning of the key 21 will not only turn the bolt 18 and hence the bracket 3, but will also first displace the bracket 3 away from the rear face of the door 10 to facilitate the turning of the bracket 3.

The proprietary SOUTHCO® latch's operating mechanism may be adapted for the purposes of the present invention by incorporating the bracket of the present invention onto the inner end of the bolt 18 in place of a latch pawl.

Although the present invention has been described above in respect of one preferred embodiment, numerous alternative embodiments fall within the spirit and scope of the invention.

What is claimed is:

1. A door security device, the device comprising in combination:

a bracket defining a stop wall, the bracket having a pivotal mount to mount, in use, to an inner face of a door with the pivotal mount extending through the thickness of the door; and an elongate prop having a first end and a second end, the first end of the prop having a pivotal mount to mount, in use, to a surface such as a wall adjacent a door and the second end of the prop serving to co-operatively engage with the stop wall of the bracket to brace the door against the adjacent surface when the bracket is in a first radial orientation but to disengage the stop wall of the bracket when the bracket is turned about the bracket's pivotal mount, the bracket being turnable about the mount by use of a key means which is co-operatively engageable with the pivotal mount of the bracket from the outer face of the door.

2. A door security device as claimed in claim 1 wherein the prop has an angle-stop to prevent the prop from swinging forward too far toward a said door whereby the prop will brace against the door or the side of the bracket rather than the stop wall of the bracket.

3. A door security device as claimed in claim 1, wherein the prop is of a unitary construction, being formed of a single tube of metal.

4. A door security device as claimed in claim 1, wherein the prop has a cap of plastics material at its second end.

5. A door security device as claimed in claim 1, wherein the bracket has a door-mounting base portion and the stop wall of the bracket is formed by a "V"-shaped extension of the door-mounting base portion.

6. A door security device as claimed in claim 1, wherein the stop wall of the bracket has a length in use, that is more than 50% greater than the diameter, or thickness, of the second end of the prop to facilitate alignment for cooperative engagement of the second end of the prop with the stop wall of the bracket.

7. A door security device as claimed in claim 1, wherein the bracket is coated with a low friction paint or other polymeric coating.

8. A door security device as claimed in claim 1, wherein the bracket has a box-section base portion that defines a void or recess therewithin into which a pivot pin of the pivotal mounting extends, and the void or recess serving to allow a fastening means to be mounted to the bolt within the void or recess to fasten the bracket to the pivot pin.

9. A door security device as claimed in claim 1, wherein the key-operated pivotal mounting of the bracket to the door is, upon turning of the key within the pivotal mounting, adapted to first advance the bracket away from the door and then turn the bracket.

10. A door security device as claimed in claim 1 installed with the first end of the elongate prop pivotally mounted to a wall or other surface adjacent a door and the bracket pivotally mounted to the door to be able to co-operatively engage with the second end of the prop.

* * * * *